US008833067B2

(12) United States Patent
Opdenbosch et al.

(10) Patent No.: US 8,833,067 B2
(45) Date of Patent: Sep. 16, 2014

(54) LOAD HOLDING FOR METERLESS CONTROL OF ACTUATORS

(75) Inventors: Patrick Opdenbosch, Peoria, IL (US); Joshua Dierking, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 728 days.

(21) Appl. No.: 13/088,999

(22) Filed: Apr. 18, 2011

(65) Prior Publication Data

US 2012/0260642 A1 Oct. 18, 2012

(51) Int. Cl.
*F16D 31/02* (2006.01)
*F15B 11/00* (2006.01)
*F15B 7/00* (2006.01)

(52) U.S. Cl.
CPC ..... *F15B 7/006* (2013.01); *F15B 2211/6313* (2013.01); *F15B 2211/761* (2013.01); *F15B 2211/27* (2013.01); *F15B 2211/20553* (2013.01); *F15B 11/003* (2013.01); *F15B 2211/613* (2013.01); *F15B 2211/50527* (2013.01); *F15B 2211/3058* (2013.01)
USPC ..... 60/459; 60/446; 60/447; 60/476

(58) Field of Classification Search
USPC ..... 60/445, 446, 447, 459, 460, 466, 475, 60/476
See application file for complete search history.

(56) References Cited

U.S. PATENT DOCUMENTS 5,329,767 A 7/1994 Hewett
5,415,076 A 5/1995 Krone et al.
6,431,050 B1 8/2002 Hausman et al.
7,185,939 B2 * 3/2007 Stark et al. ..... 60/476
7,478,489 B2 1/2009 Anderson et al.
7,516,613 B2 4/2009 Kadlicko
7,827,787 B2 * 11/2010 Cherney et al. ..... 60/459
8,407,993 B2 * 4/2013 Vigholm et al. ..... 60/476
2003/0159577 A1 8/2003 Pfaff et al.
2004/0021103 A1 2/2004 Yang et al.

(Continued)

FOREIGN PATENT DOCUMENTS

WO 2009/102740 A2 8/2009
WO 2010-054155 5/2010

OTHER PUBLICATIONS

Grabbel et al., "An investigation of swash plate control concepts for displacement controlled actuators," International Journal of Fluid Power, 6 (2): 19-36 (TuTech Innovation GmbH, Hamburg, Germany, Aug. 2005).

(Continued)

*Primary Examiner* — Michael Leslie
(74) *Attorney, Agent, or Firm* — Leydig, Voit & Mayer, Ltd.

(57) ABSTRACT

First and second mechanical hydraulic valves are disposed between a pump and the cap side chamber of an actuator and the pump and the rod chamber of the pump. The first and second valves are actuated as a result of respective pressure differentials applied across the valves. A controller controls flow from a pump in response to a commanded motion to control movement of the actuator, and cause the valves to open. The valves are disposed in their no-flow positions when the pump is not operative, and when the hydraulic system of off or locked out to hold a load.

19 Claims, 7 Drawing Sheets

(56) References Cited

U.S. PATENT DOCUMENTS

| | | | | |
|---|---|---|---|---|
| 2004/0055453 | A1 | 3/2004 | Tabor | |
| 2005/0211936 | A1 | 9/2005 | Tabor et al. | |
| 2006/0090460 | A1 | 5/2006 | Ma et al. | |
| 2008/0034853 | A1 | 2/2008 | Tabor et al. | |
| 2008/0110166 | A1 | 5/2008 | Stephenson et al. | |
| 2008/0295508 | A1 | 12/2008 | Ma et al. | |
| 2009/0064676 | A1 * | 3/2009 | Tikkanen | 60/572 |
| 2009/0165450 | A1 | 7/2009 | Cherney et al. | |
| 2010/0115936 | A1 * | 5/2010 | Williamson et al. | 60/446 |

OTHER PUBLICATIONS

Wang et al., "A hydraulic circuit with dynamical compensations," Institute for Fluid Power Education, 52nd National Conference on Fluid Power (IFPE 2011), Session 19.3, 529-538 (Las Vegas, Nevada, USA, Mar. 24, 2011).

Williamson et al., "Stability and motion control of inertial loads with displacement controlled hydraulic actuators," Proceedings of the 6th Fluid Power Network International (FPNI) Ph.D. Symposium (West Lafayette, Indiana, USA, Jun. 15-19, 2010).

* cited by examiner

LOAD HOLDING FOR METERLESS CONTROL OF ACTUATORS

TECHNICAL FIELD

This patent disclosure relates generally to a hydraulic circuit for a double acting piston and cylinder, and, more particularly to arrangements for load holding in a system including a displacement-controlled actuator.

BACKGROUND

So-called meterless hydraulic control circuits control the motion of a hydraulic actuator by controlling a flow from one chamber of the actuator to the other utilizing one or more pumps, that is, flow rate from the pump(s) is used to control the flow to and/or from the chambers of the actuator, as opposed to utilizing proportional valves. Proportional or throttling valves are utilized in prior art metered systems to restrict or meter the fluid flow therethrough to control movement of the actuator. In contrast, in meterless systems, the pump(s) may be of a variable displacement type or of a fixed displacement type wherein the flow from the pump to the actuator chambers is varied in order to control the speed of the actuator movement. In prior art meterless arrangements, pump controlled circuits known as Displacement Controls (DC) utilize a variable displacement pump with a constant speed driver, while Electro-Hydrostatic Actuators (EHA) utilize a fixed displacement pump with a variable speed driver.

Inasmuch as flow to and from the chambers of the actuator is controlled by the pump, under certain conditions, unintended motion can happen when there is a change in load even though there is no operator command. For example, when the pump displacement is zero, the machine is turned off, or an implement lockout switch is set to disable hydraulic operation of the implement system, the load can sometimes slip to a different position. One such meterless hydraulic control circuit is shown, for example, in U.S. Publication 2009/0165450. In this arrangement, six solenoid valves are utilized to control the flow through various conduits, the pump and a tank. In order to hold the load, five solenoid valves must be maintained in the closed position.

SUMMARY

In one aspect of the disclosure, there is described a hydraulic system including an actuator having a piston disposed within a cylinder, and a rod extending from the piston and extending out of the cylinder, the piston defining a rod chamber and a cap side chamber within the cylinder. A pump is adapted to operate as a pump or as a motor, and to deliver pressurized hydraulic fluid to and receive pressurized hydraulic fluid from the chambers of the actuator. The pump selectively provides varied flow rates. The movement of the piston relative to the cylinder is dependent upon the selectively varied flow rates. A controller is adapted to control the displacement of the pump in response to a commanded motion and relative positions of the piston and cylinder. A rod side fluid connection fluidly connects the pump and the rod chamber, while a cap side fluid connection fluidly connects the pump and the cap side chamber. A first mechanical hydraulic valve is disposed in the cap side fluid connection, the first mechanical hydraulic valve having at least a first position preventing flow through the cap side fluid connection, and a second position permitting flow through the cap side fluid connection. The first mechanical hydraulic valve is adapted to be disposed in at least one of its first or second positions as a result of a first hydraulic pressure differential applied across the first mechanical hydraulic valve. A second mechanical hydraulic valve is disposed in the rod side fluid connection, the second mechanical hydraulic valve having at least a first position preventing flow through the rod side fluid connection, and a second position permitting flow through the rod side fluid connection. The second mechanical hydraulic valve is adapted to be disposed in at least one of its first or second positions as a result of a second hydraulic pressure differential applied across the second mechanical hydraulic valve. The first and second mechanical hydraulic valves are maintained in the respective first positions when the pump is not operative.

In another aspect, there is disclosed a method of controlling a hydraulic system including an actuator having a piston disposed within a cylinder, and a rod extending from the piston and extending out of the cylinder, the piston defining a rod chamber and a cap side chamber within the cylinder, a pump, a rod side fluid connection between the pump and the rod chamber, and a cap side fluid connection between the pump and the cap side chamber, the pump adapted to deliver pressurized fluid to and receive pressurized fluid from the chambers of the actuator. The method includes comprising the steps of disposing a first mechanical hydraulic valve in the cap side fluid connection, the first valve having at least a first position substantially preventing flow through the cap side fluid connection, and a second position permitting flow through the cap side fluid connection; disposing a second mechanical hydraulic valve in the rod side fluid connection, the second valve having at least a first position substantially preventing flow through the rod side fluid connection, and a second position permitting flow through the rod side fluid connection; moving the first mechanical hydraulic valve from its first position to its second position to allow flow through the cap side fluid connection when motion of the actuator is commanded; moving the second mechanical hydraulic valve from its first position to its second position to allow flow through the rod side fluid connection when motion of the actuator is commanded; controlling the pump to control the flow rate in response to relative positions of the piston and cylinder and a commanded motion of the actuator; moving the first mechanical hydraulic valve from its second position to its first position when at least one of movement of the piston is not commanded or the hydraulic system is turned off; and moving the second mechanical hydraulic valve from its second position to its first position when at least one of movement of the piston is not commanded or the hydraulic system is turned off. At least one of the steps of moving occurs as a result of a pressure differential across the respective mechanical hydraulic valve.

In yet another aspect, there is disclosed a method of controlling a hydraulic system including an actuator having a piston disposed within a cylinder, and a rod extending from the piston and extending out of the cylinder, the piston defining a rod chamber and a cap side chamber within the cylinder, a pump, a rod side fluid connection between the pump and the rod chamber, and a cap side fluid connection between the pump and the cap side chamber, the pump adapted to deliver pressurized fluid to and receive pressurized fluid from the chambers of the actuator. The method includes the steps of: disposing a first load holding valve in the cap side fluid connection, the first valve having at least a first position substantially preventing flow through the cap side fluid connection, and a second position permitting flow through the cap side fluid connection; disposing a second load holding valve in the rod side fluid connection, the second valve having at least a first position substantially preventing flow through the rod side fluid connection, and a second position permitting flow through the rod side fluid connection; controlling the pump to control the flow rate in response to relative positions of the piston and cylinder and a commanded motion of the actuator; moving the first load holding valve from its first position to its second position to allow flow through the cap side fluid connection when motion of the actuator is commanded; moving the second load holding valve from its first position to its second position to allow flow through the rod side fluid connection when motion of the actuator is commanded; determining when the piston is within a predetermined distance of an end of the cylinder; cushioning the movement of the piston as it nears the end of the cylinder by controllably moving at least one of the first or second load holding valves from its second position to its first position to reduce a flow rate of fluid to and from the rod and cap side chambers; moving the first load holding valve from its second position to its first position when the pump is not commanded, the hydraulic system is turned off, or hydraulic operation of the actuator is locked out; and moving the second load-holding valve from its second position to its first position when at least one of the pump is not commanded, the hydraulic system is turned off, or hydraulic operation of the actuator is locked out.

BRIEF DESCRIPTION OF THE DRAWING(S)

DETAILED DESCRIPTION

Figure 1:
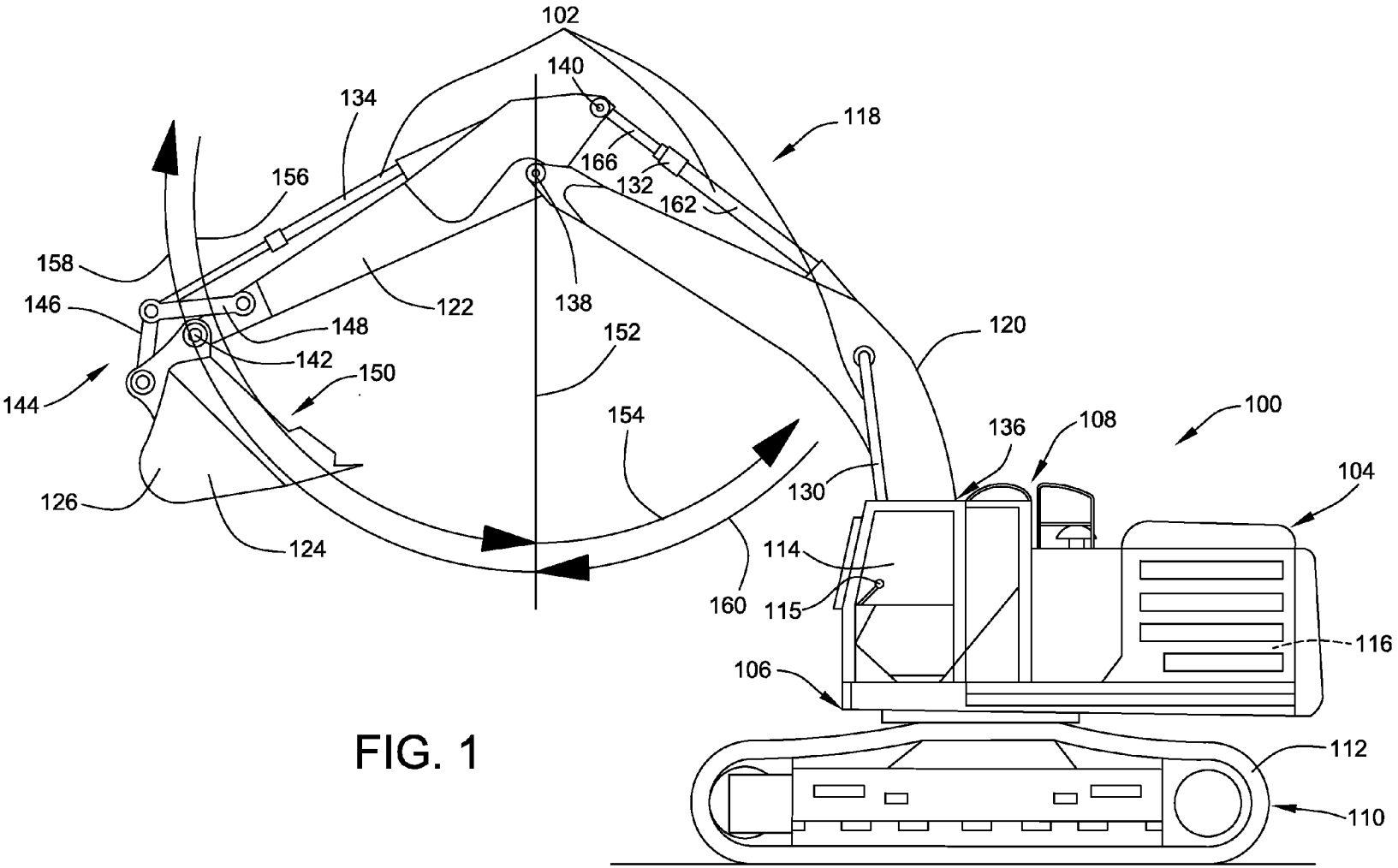
FIG. 1 is a side elevational view of a machine incorporating aspects of this disclosure.

This disclosure relates to machines 100 that utilize hydraulic actuators (identified generally as 102) to control movement of moveable subassemblies of the machine, such as arms, booms, implements, or the like. More specifically, the disclosure relates to such so-called meterless hydraulic systems 104 utilized in machines 100, such as the excavator 106 illustrated in FIG. 1, used to control extension and retraction of such hydraulic actuators 102. While the arrangement is illustrated in connection with an excavator 106, the arrangement disclosed herein has universal applicability in various other types of machines 100 as well. The term "machine" may refer to any machine that performs some type of operation associated with an industry such as mining, construction, farming, transportation, or any other industry known in the art. For example, the machine may be a wheel loader or a skid steer loader. Moreover, one or more implements may be connected to the machine 100. Such implements may be utilized for a variety of tasks, including, for example, brushing, compacting, grading, lifting, loading, plowing, ripping, and include, for example, augers, blades, breakers/hammers, brushes, buckets, compactors, cutters, forked lifting devices, grader bits and end bits, grapples, blades, rippers, scarifiers, shears, snow plows, snow wings, and others.

The excavator 106 of FIG. 1 includes a cab 108 that is swingably supported on an undercarriage 110 that includes a pair of rotatably mounted tracks 112. The cab 108 includes an operator station 114 from which the machine 100 may be controlled. The operator station 114 may include, for example, an operator control 115 for controlling the extension and retraction of the hydraulic actuators 102. The operator control 115 may be of any appropriate design. By way of example only, the operator control 115 may be in the form of joystick, such as illustrated in FIG. 1, a dial, a switch, a lever, a combination of the same, or any other arrangement that provides the operator with a mechanism by which to identify the movement commanded. The operator station 114 may further include controls such as a hydraulic lockout switch 113, or an on/off switch 111.

The cab 108 may further include an engine 116, and at least a portion of the meterless hydraulic system 104. The engine 116 may be an internal combustion engine or any type power source known to one skilled in the art now or in the future.

A front linkage 118 includes a boom 120 that is pivotably supported on the cab 108, a stick 122 pivotably coupled to the boom 120, and an implement 124 pivotably coupled to the stick 122. While the implement 124 is illustrated as a bucket 126, the implement 124 may alternately be, for example, a compactor, a grapple, a multi-processor, thumbs, a rake, a ripper, or shears.

Movement of the boom 120, stick 122, and implement 124 is controlled by a number of actuators 130, 132, 134. The boom 120 is pivotably coupled to cab 108 at one end 136. To control movement of the boom 120 relative to the cab 108, a pair of actuators 130 are provided on either side of the boom 120, coupled at one end to the cab 108, and at the other end to the boom 120.

The stick 122 is pivotably coupled to the boom 120 at a pivot connection 138. Movement of the stick 122 relative to the boom 120 is controlled by the actuator 132 that is coupled at one end to the boom 120, and at the other end to the stick 122. The actuator 132 is pivotably coupled to the stick 122 at a pivot connection 140 that is spaced from the pivot connection 138 such that extension and retraction of the actuator 132 pivots the stick 122 about pivot connection 138.

The implement 124 is pivotably coupled to the stick 122 at pivot connection 142. Movement of the implement 124 relative to the stick 122 is controlled by actuator 134. The actuator 134 is coupled to the stick 122 at one end. The other end of the actuator 134 is coupled to a four-bar linkage arrangement 144 that includes a portion of the stick 122 itself, as well as the implement 124 and a pair of links 146, 148. The actuator 134 is extended in order to move the stick 122 toward the cab (counterclockwise in the illustrated embodiment), and retracted in order to move the stick 122 away from the cab (clockwise in the illustrated embodiment).

Figure 2:
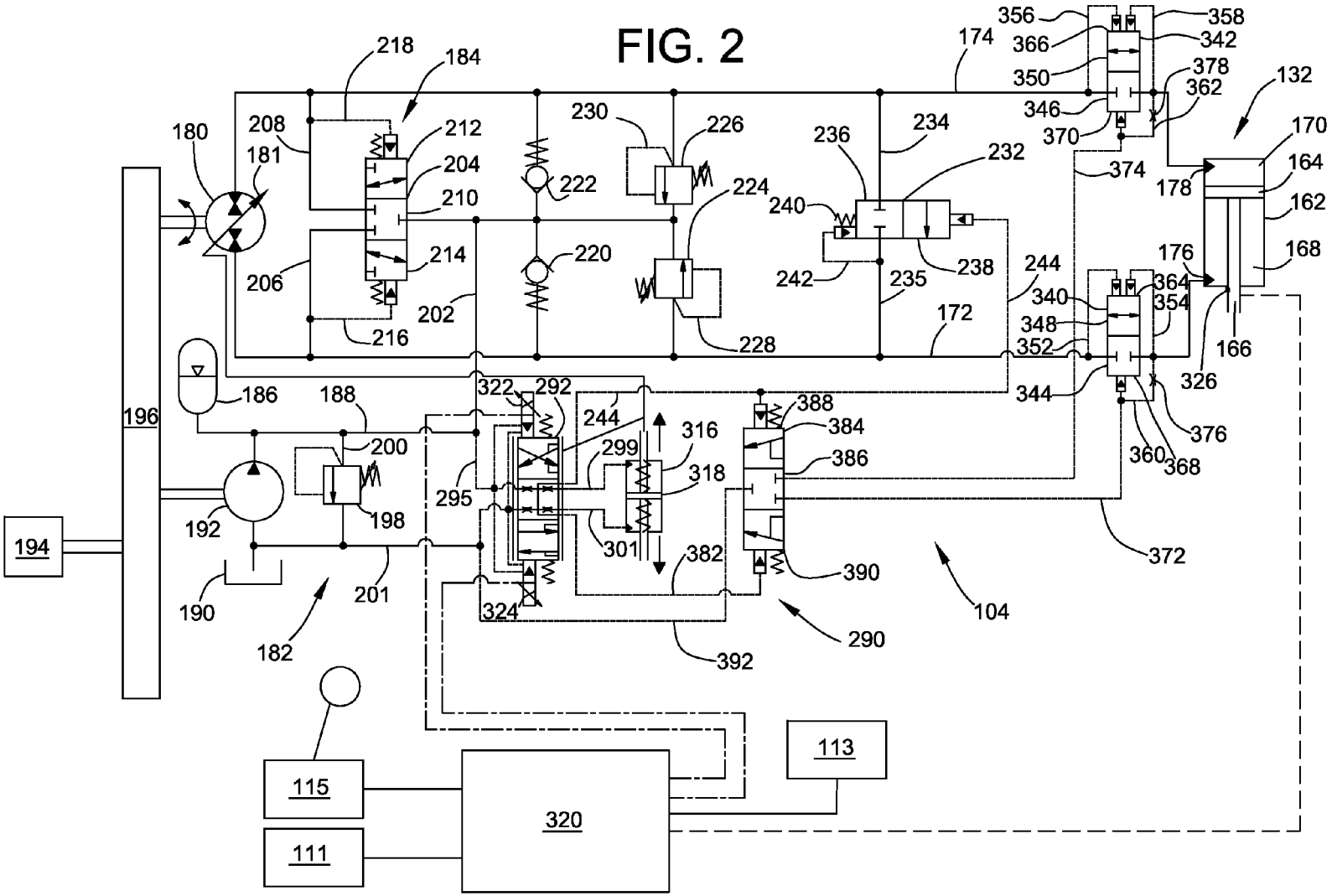
FIG. 2 is a schematic view of a hydraulic system according to this disclosure.

Movement of the actuator 132 is controlled by the meterless hydraulic system 104, which is shown in greater detail in FIG. 2. While the explanation of the hydraulic system 104 is explained below with regard to actuator 132, the explanation is equally applicable to the other actuators 130, 134, as well as any actuator operated by a similar so-called "meterless" hydraulic system 104.

The actuator 132 includes a cylinder 162 in which a piston 164 is slidably disposed. A rod 166 is secured to the piston 164, and extends from the cylinder 162. In this way, the piston 164 divides the interior of the cylinder 162 into a rod chamber 168 and a cap side chamber 170. In operation, as the actuator 132 is extended, hydraulic fluid flows from the rod chamber 168 and hydraulic fluid flows into the cap side chamber 170 as the piston 164 and rod 166 slide within the cylinder 162 to telescope the rod 166 outward from the actuator 132. Conversely, as the actuator 132 is retracted, hydraulic fluid flows into the rod chamber 168 and hydraulic fluid flows out of the cap side chamber 170 as the piston 164 and rod 166 slide within the cylinder 162 to retract the rod 166 into the cylinder 162. Flow of hydraulic fluid to and from the rod and cap side chambers 168, 170 proceeds through a rod side fluid connection 172 and a cap side fluid connection 174, respectively, that are fluidly coupled to respective ports 176, 178 opening in the rod or cap side chambers 168, 170 in the cylinder 162.

Flow between the rod and cap side chambers 168, 170 through the rod side and cap side fluid connections 172, 174 is provided by a pump 180 wherein the flow rate from the pump may be varied. In this way, the pump 180 controls the operation of actuator 132, rather than so-called metering valves. The illustrated pump 180 is a variable displacement pump 180, which includes a swash plate 181, the angle of which determines the positive or negative displacement of the pump 180, and volume of flow from the pump 180. It will thus be appreciated that the displacement of the pump 180, and, accordingly, the flow rate is controlled in order to control both the direction and volume of the flow of hydraulic fluid to provide extension and retraction of the actuator 132 as commanded by the operator. While a pump 180 is illustrated, the pump 180 may alternately be a fixed displacement pump wherein the speed may be varied by an associated driving motor.

The pump 180 may operate as a pump to positively pump fluid from one fluid connection 172, 174 to the other 172, 174, or a motor as fluid flows from one fluid connection 172, 174 to the other 172, 174. More specifically, as an extension or a retraction of the actuator 132 is commanded against the force of the load 150, as along the arcs identified as 154 or 158, respectively, in FIG. 1, the pump 180 acts as a pump, pumping hydraulic fluid from one chamber 168, 170 to the other 168, 170. Conversely, when an extension or a retraction of the actuator 132 is commanded in the same direction as the force of the load 150, as in the arcs identified as 156 or 160, respectively, in FIG. 1, the force of the load 150 causes a movement of fluid from one chamber 168, 170 to the other 168, 170 such that the energy of fluid motion allows the pump 180 to be operated as a motor. The flow of hydraulic fluid to and from the chambers 168, 170 as the stick 122 and implement 124 move along the arcs 154, 156, 158, 160 are illustrated by arrows in FIGS. 3-6, respectively.

It will be appreciated by those of skill in the art that the respective volumes of hydraulic fluid flowing into and out of the rod and cap side chambers 168, 170 during extension and retraction of the actuator 132 are not equal. This is a result of the difference in surface area of the piston 164 on the rod and cap side chambers 168, 170, that is, the surface area of the piston 164 where the rod 166 extends from the piston 164 is less than the surface area of the piston 164 facing the cap side chamber 170. Consequently, during retraction of the actuator 132, more hydraulic fluid flows from the cap side chamber 170 than can be utilized in the rod chamber 168. Conversely, during extensions of the actuator 132, additional hydraulic fluid is required to supplement the hydraulic fluid flowing from the rod chamber 168 in order to fill the cap side chamber 170. To receive this excess hydraulic fluid and provide this supplemental hydraulic fluid, a charge circuit 182 and make-up hydraulic circuit 184 are provided, as shown in FIG. 2.

The charge circuit 182 includes at least one hydraulic fluid source, two of which are provided in the illustrated embodiment. The illustrated charge circuit 182 includes an accumulator 186 that may be utilized to provide a source of pressurized hydraulic fluid or that may be charged with excess hydraulic fluid through a charge conduit 188. The illustrated charge circuit 182 additionally includes a tank 190 from which hydraulic fluid may be provided by a second pump 192 through the charge conduit 188. Excess hydraulic fluid, either from the second pump 192 or operation of the actuator 132 may be returned to either the accumulator 186, or to the tank 190 by way of a charge pilot valve 198 disposed in a charge pilot conduit 200, which is fluidly connected to return conduit 201. The charge pilot valve 198 is operated as a result of fluid pressure in the conduit 200 along the inlet side of the charge pilot valve 198, although an alternate method of operation may be provided. In this embodiment, the pump 180 and the second pump 192 are both operated by a prime mover 194, such as the engine 116, through a gearbox 196. In an alternate embodiment, one or both of the pumps 180, 192 may connected directly to the engine 116 or prime mover 194 shaft with no speed ratio change. The pump 180 and/or the second pump 192 may alternately be operated by a battery or other power storage arrangement. It will further be appreciated that the second pump 192 may be selectively operated, or continuously operated, as in the illustrated embodiment, depending upon the arrangement provided.

The make-up hydraulic circuit 184 includes a make-up conduit 202 that is fluidly coupled to the charge conduit 188, a make-up valve 204, a rod side make-up conduit 206 and a cap side make-up conduit 208, which are fluidly coupled to the rod side fluid connection 172 and the cap side fluid connection 174, respectively. The make-up valve has three positions. The first, central default position 210 prevents flow to or from each of conduits 202, 206, 208. Alternatively, the central default position may be constructed such that conduit 208 is connected to conduit 202 by an orifice (not shown), and conduit 206 is connected to conduit 202 by an orifice (not shown); this connection using orifices may be desirable if the pump 180 does not return to a perfect zero displacement when commanded to neutral. For the purposes of this disclosure, however, any reference to the central default position 210 being considered a no-flow position is intended to include both illustrated design wherein no connections is made, and a situation wherein orifices are disposed between the conduits 208, 206 and the conduit 202 to severely limit any flow therethrough. The second position 212 fluidly couples the make-up conduit 202 and the rod side make-up conduit 206 to allow flow therethrough, and prevent flow to or from the cap side make-up conduit 208. The third position 214 fluidly couples the make-up conduit 202 and the cap side make-up conduit 208 to allow flow therethrough, and prevent flow to or from the rod side make-up conduit 206.

In order to operate the make-up valve 204, pilot connections 216, 218 are provided from the rod and cap side make-up conduits 206, 208, respectively. Thus, the make-up valve 204 is operative as a result of a minimum pressure differential between the pilot connections 216, 218. While very little flow occurs through the pilot connections 216, 218, it will be appreciated that the pressure from the rod side fluid connection 172 is applied to the pilot connection 216 by way of the rod side make-up conduit 206. Similarly, the pressure from the cap side fluid connection 174 is applied to the pilot connection 218 by way of the cap side make-up conduit 208.

When the pressure on the cap side pilot connection 218 is sufficiently greater than the pressure on the rod side pilot connection 216, the make-up valve 204 will move to its second position 212. Conversely, when the pressure on the rod side pilot connections 216 is sufficiently greater than the pressure on the cap side pilot connection 218, the make-up valve 204 will move to its third position 214.

It will be noted that the make-up circuit 184 may include additional valving arrangements. By way of example, the make-up circuit 184 may include check valves 220, 222 that are operative at set pressure differentials between the make-up conduit 202 and the rod side and cap side fluid connections 172, 174, respectively. It will be appreciated that the check valves 220, 222 will unseat to permit flow if the pressure within the make-up conduit 202 is sufficiently greater than the pressures in rod side and cap side fluid connections 172, 174, respectively. The check valves 220, 222 may include any device for limiting flow in a piping system to a single direction known by one skilled in the art now and in the future.

Similarly, as a safety check, cross-over relief valves 224, 226 may be provided to permit flow between the rod and cap side fluid connections 172, 174, respectively, and the conduit 202, allowing fluid to be returned to the tank 190 in the event a pressure developed in the rod or cap side fluid connections 172, 174 exceeds a set valve. More specifically, relief valve 224 will operate when the pilot connection 228 indicates that the pressure in the rod side fluid connection 172 exceeds a set value. Similarly, relief valve 226 will operate when the pilot connection 230 indicates that the pressure in the cap side fluid connection 174 exceeds a set value. These relief valves 224, 226 would typically be set to operate at relatively large pressure levels in order to prevent damage to the system, as, for example, when piston 164 reaches the end of stroke while the flow from the pump 180 is nonzero, or when there is a failure in other components of the hydraulic system 104. The relief valves 224, 226 may include any selectively operational device for providing flow in a piping system known by one skilled in the art now and in the future.

In order to prevent or minimize overspeeding during a motoring retraction, the meterless hydraulic system 104 may be provided with at least one regeneration valve 232 disposed in a regeneration conduit 234/235 between the piston and rod side fluid connections 174, 172. The regeneration valve 232 is selectively operable between a default position 236 and an actuated position 238 the allows flow from the cap side fluid connection 174 directly to the rod side fluid connection 172 through the regeneration conduit 234/235, rather than all fluid being directed through the pump 180. During all modes of operation other than a motoring retraction, the regeneration valve 232 does not permit flow directly through the regeneration conduit 234/235 from the cap side fluid conduit 174 to the rod side fluid conduit 172; the regeneration valve 232 is actuated to allow flow from the cap side fluid conduit 174 through the regeneration conduit 234/235 to the rod side fluid connection 172 only during a motoring retraction. The regeneration valve 232 may be operated from a pilot line 244 from conduit 299. The regeneration valve 232 may be operated by any appropriate arrangement. For example, the regeneration valve 232 may be operated hydraulically, as illustrated in FIGS. 2 and 7, as explained in conjunction with the explanation of the control of the pump 180.

Figure 7:
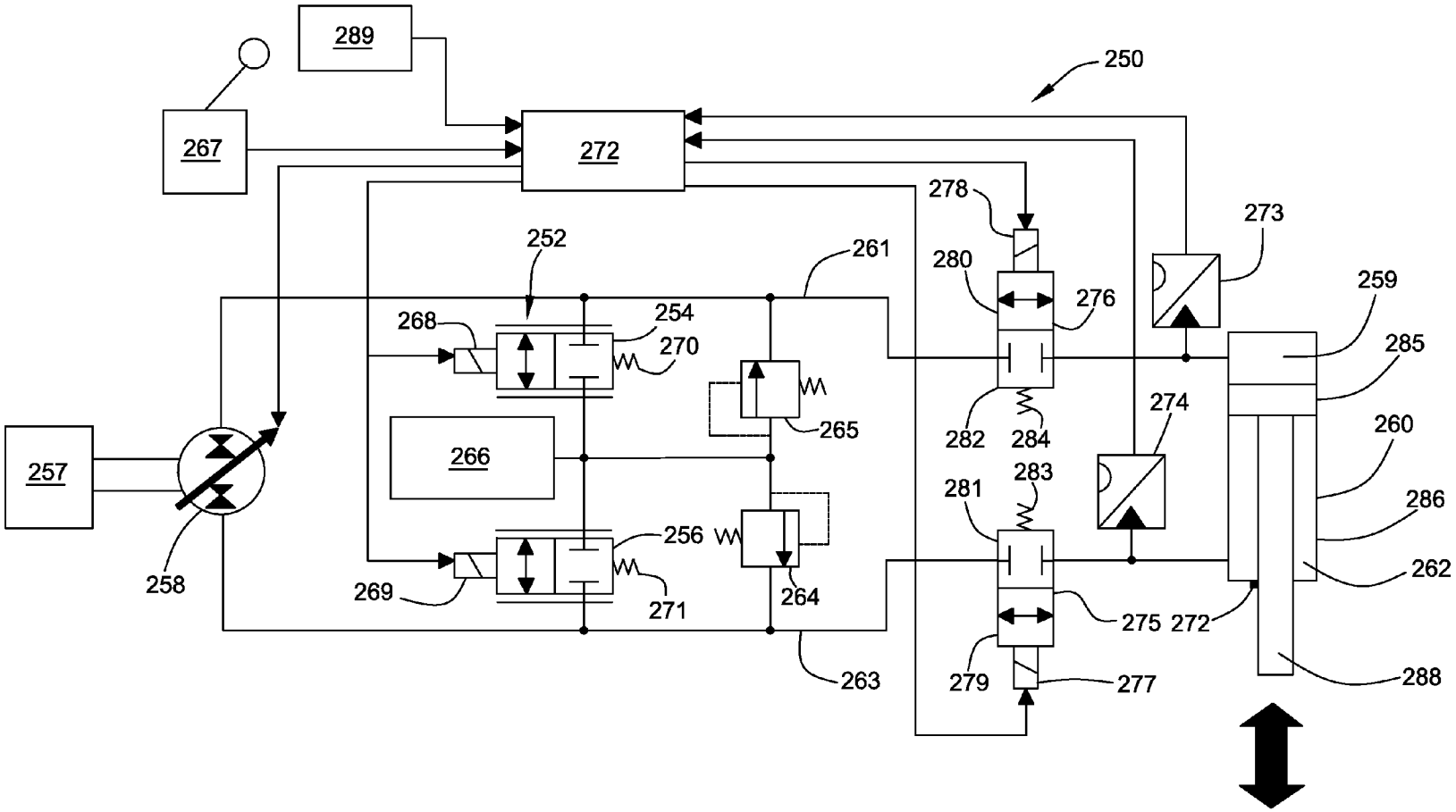
FIG. 7 is a schematic view of an alternate embodiment of a hydraulic system according to this disclosure.

Turning now to the control of the pump 180, in the embodiment illustrated in FIGS. 2 and 7, an electro-hydraulic displacement control circuit 290 including mechanical position feedback is provided in order to control the position of the swash plate 181 of the pump 180. It will be appreciated, however, that the pump 180 may be controlled by an appropriate arrangement. The displacement control circuit 290 illustrated is provided by way of example only; any appropriate control may be utilized. The displacement control circuit 290 includes at least one displacement control valve 292 and a plurality of connecting conduits controlling flow to and from a swash plate control assembly 316, and a load holding control valve 384, the significance of which will be discussed below. In the illustrated embodiment, the displacement control valve 292 is a solenoid actuated multi-position valve. The displacement control valve 292 includes four ports identified as 294, 296, 298, 300, and has three positions, identified as 302, 304, 306.

Port 294 is fluidly connectable to conduit 295, which is fluidly coupled to charge conduit 188 of the charge circuit 182. Port 296 is fluidly connectable to conduit 297, which is fluidly coupled to return conduit 201 of the charge circuit 182. Port 298 is fluidly connectable to conduit 299, while port 300 is fluidly connectable to conduit 301, conduits 299 and 301 providing flow to the swash plate control assembly 316. Port 398 is fluidly connectable to pilot line 244, while port 399 is fluidly connectable to pilot line 382, pilot lines 244, 382 providing pressure load holding valve 384.

When the system 104 is in neutral, the control valve 292 is in the central, default position 302. as a result, port 294 is maintained substantially at charge pressure, while the remaining ports 296, 298, 300, 398, 399 are at close to tank 190 pressure.

The second and third, activated positions 304, 306 provide cross flow between different sets of ports 294, 296, 298, 300, 398, 399. The second, activated position 304 provides for flow from port 294 to ports 300, 399, and flow from ports 298, 398 to port 296, that is, from conduit 295 to conduit 301 and pilot line 382, and from conduit 299 and pilot line 244 to conduit 297. The third, activated position 306 provides for flow from port 294 to ports 298, 398, and flow from ports 300, 399 to port 296, that is, from conduit 295 to conduit 299 and pilot line 244, and from conduit 301 and pilot line 382 to conduit 297.

Flow from conduits 299, 301 to ports 312, 314 at either end of the swash plate control assembly 316 control the motion and shift of an element 318 within the swash plate control assembly 316. Those of skill in the art will appreciate that the location of the piston 318 controls the position of the swash plate 181, and, therefore, the displacement of the pump 180, and the associated flow rate. When in neutral, the swash plate control assembly 316 is centered by biasing force such as springs, such that the pump 180 will provide for zero displacement.

Figure 3:
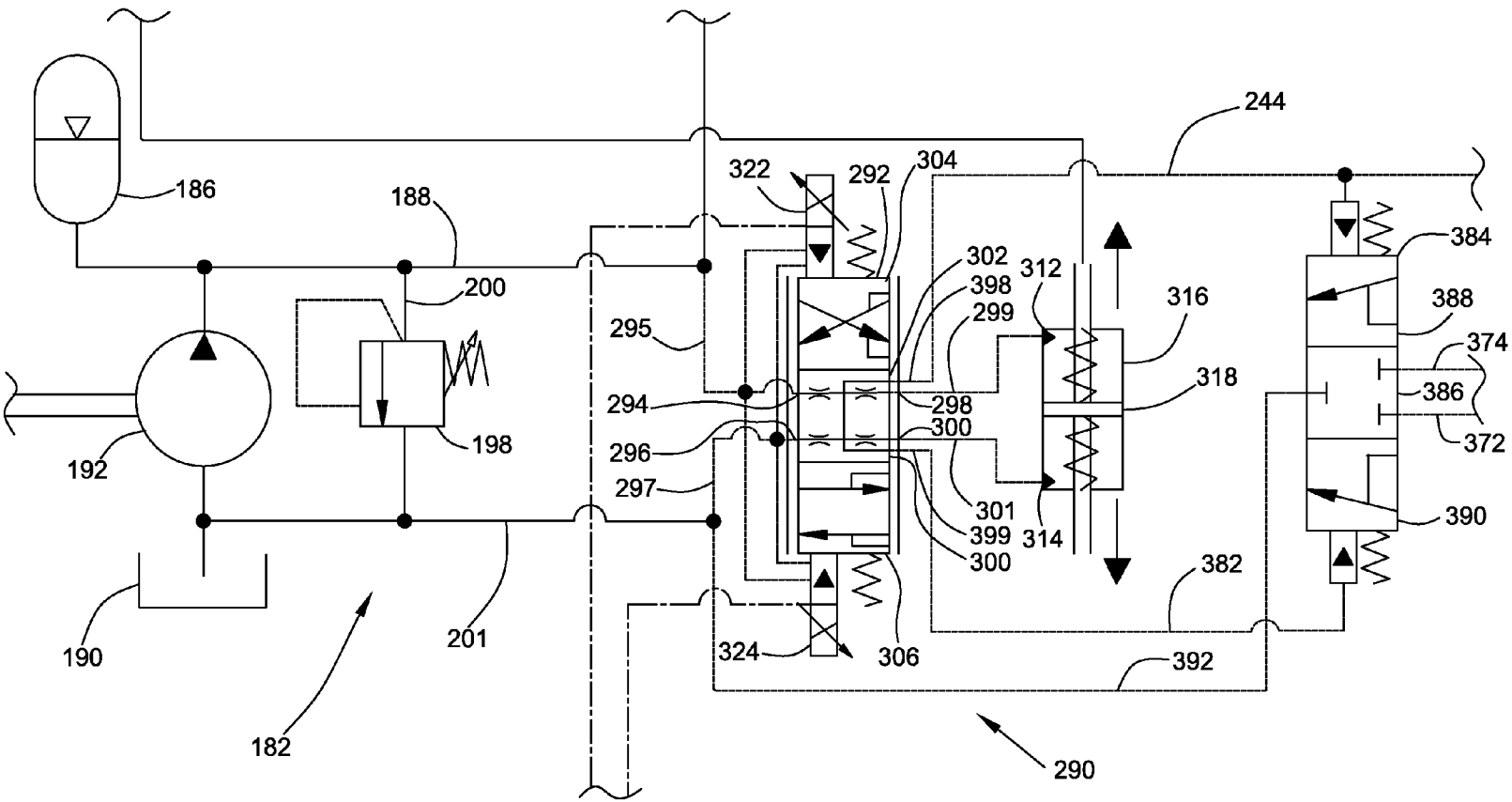
FIG. 3 is an enlarged fragmentary view of the pump displacement control of FIG. 2.

When the control valve 292 is in the second, activated position identified as 304, however, flow is directed from conduit 295 from the charge circuit 182, through ports 294 and 300 to conduit 301 and port 314 of the swash plate control assembly 316, while flow from the opposite side of the swash plate control assembly 316 is directed through port 312, conduit 299, port 298, port 296 to conduits 297 and 201 to return to the tank 190. This movement (upward as illustrated in FIGS. 2-3) results in positioning of the swash plate 181 to provide a positive displacement of the pump 180, the angle of the swash plate 181 determining the volume of fluid displaced.

When the control valve 292 is in the third, activated position identified as 306, flow is directed from conduit 295 from the charge circuit 182, through ports 294 and 298 to conduit 299, through port 312 of the swash plate control assembly 316, while flow from the opposite side of the piston assembly 318 is directed through port 314, conduit 301, port 300, port 296 to conduits 297 and 201 to return to the tank 190. This movement (downward as illustrated in FIGS. 2-3) yields positioning of the swash plate 181 to provide a negative displacement of the pump 180, the angle of the swash plate 181 determining the volume of fluid displaced.

In use, the operator utilizes the operator control 115 to provide a signal that identifies the desired movement to a controller 320 (see FIG. 2). In the embodiment illustrated in FIGS. 2-3, this signal identifies the desired movement of the actuator 132. Based upon one or more signals, including the signal from the operator control 115, and, for example, the current position of the actuator 132, the controller 320 provides a signal to the solenoid 322, 324 at either end of the valve 292 to advance the valve 292 to the desired position 302, 304, 306. The current position of the actuator 132 may be determined, for example, by way of one or more sensors 326 provided, by way of further example, on the rod 166 or cylinder 162 of the actuator 132. Alternately, the position of the piston 164 within the actuator 132 may be estimated by techniques known to those of skill in the art. It will be appreciated, however, that any appropriate method of determining the position of the actuator 132 now known or identified in the future may be utilized.

In meterless hydraulic systems, under certain conditions, unintended motion can happen when there is a change in load even though there is no operator command. In order to substantially prevent a lowering of the load, load holding valves 340, 342 are provided in the rod and cap side fluid connections 172, 174, respectively. The load holding valves 340, 342 substantially prevent flow to and from the rod chamber 168 and the cap side chamber 170, for example, when movement of the pump 180 is not commanded, the hydraulic system 104 is turned off, or hydraulic operation of the actuator 132 is locked out. The load holding valves 340, 342 include default positions 344, 346 that substantially prevent flow through the valves 340, 342, and active positions 348, 350 that allow flow through the rod side fluid connection 172 or the cap side fluid connection 174, that is, to and from the rod and cap side chambers 168, 170, respectively. The load holding valves 340, 342 are disposed in the default positions 344, 346 when movement of the pump 180 is not commanded, the hydraulic system 104 is turned off, or hydraulic operation of the actuator 132 is locked out. In this way, the load holding valves 340, 342 substantially prevent undesirable movement of the actuator 132, as may result from system leakage or the like when the displacement of the variable displacement pump 180, 258 is zero or when the engine is off. Conversely, the load holding valves 340, 342 are disposed in the active positions 348, 350 when a position of the actuator 132 is commanded, and the variable displacement pump 180 is actuated, allowing for execution of actuator commands.

Actuation of the load holding valves 340, 342 may be provided by any appropriate arrangement. In the embodiment shown in FIGS. 2-3, hydro-mechanical actuation of the load holding valves 340, 342 is provided. To this end, a plurality of fluid takeoffs or pilots 352, 354, 356, 358, 360, 362 from the rod and cap side fluid connections 172, 174 to either end of the load holding valves 340, 342.

More specifically, pilots 352, 354 are provided from the rod side fluid connection 172 along either flow side of the load holding valve 340 to provide fluid pressure to a first actuating end or surface(s) 364 of the load holding valve 340. That is, pilot 352 fluidly couples the rod side fluid connection 172 between the load holding valve 340 and the pump 180 to the first actuating end or surface(s) 364 of the load holding valve 340. In this way, fluid pressure from the rod side fluid connection 172 between the load holding valve 340 and the pump 180 is applied through the pilot 352 to the first actuating end or surface(s) 364 of the load holding valve 340 to urge the load holding valve 340 from the no-flow position 344 to the flow position 348.

Similarly, pilot 354 fluidly couples the rod side fluid connection 172 between the load holding valve 340 and the actuator 132 to the first actuating end or surface(s) 364 of the load holding valve 340. In this way, fluid pressure from the rod side fluid connection 172 between the load holding valve 340 and the actuator 132 is applied through pilot 354 to the first actuating end or surface(s) 364 of the load holding valve 340 to urge the load holding valve 340 from the no-flow position 344 to the flow position 348.

Turning to load holding valve 342, pilot 356 fluidly couples the cap side fluid connection 174 between the load holding valve 342 and the pump 180 to the first actuating end or surface(s) 366 of the load holding valve 342. In this way, fluid pressure from the cap side fluid connection 174 between the load holding valve 342 and the pump 180 is applied through the pilot 356 to the first actuating end or surface(s) 366 of the load holding valve 342 to urge the load holding valve 342 from the no-flow position 346 to the flow position 350.

Pilot 358 fluidly couples the cap side fluid connection 174 between the load holding valve 342 and the actuator 132 to the first actuating end or surface(s) 366 of the load holding valve 342. In this way, fluid pressure from the cap side fluid connection 174 between the load holding valve 342 and the actuator 132 is applied through pilot 358 to the first actuating end or surface(s) 366 of the load holding valve 342 to urge the load holding valve 342 from the no-flow position 346 to the flow position 350.

Pilots 360, 362 are additionally provided to respective second actuating ends or surfaces 368, 370 of the load holding valves 340, 342. More particularly, turning first to load holding valve 340, pilot 360 couples the rod side fluid connection 172 between the load holding valve 340 and the actuator 132 to the second actuating end or surface(s) 368 of the load holding valve 340. In this way, fluid pressure from the rod side fluid connection 172 between the load holding valve 340 and the actuator 132 is applied through pilot 354 to the second actuating end or surface(s) 368 of the load holding valve 340 to urge the load holding valve 340 to the no-flow position 344 from the flow position 348.

Turning next to load holding valve 342, pilot 362 fluidly couples the cap side fluid connection 174 between the load holding valve 342 and the actuator 132 to the second actuating end or surface(s) 370 of the load holding valve 342. In this way, fluid pressure from the cap side fluid connection 174 between the load holding valve 342 and the actuator 132 is applied through pilot 362 to the second actuating end or surface(s) 370 of the load holding valve 342 to urge the load holding valve 342 to the no-flow position 346 from the flow position 350.

In order to facilitate movement of the load holding valves 340, 342 from their no-flow positions 344, 346 to their flow positions the second actuating ends or surfaces 368, 370 of the load holding valves 340, 342, respectively, are selectively connectable to the tank 190 by way of conduits 372, 374. Thus, when conduits 372, 374 are connected to the tank 190, fluid from the second actuating ends or surfaces 368, 370 may drain to the tank 190. The details of the selective connection of the second actuating ends or surfaces 368, 370 to the tank 190 will be discussed in greater detail below.

In the illustrated embodiment, pilots 360, 362 are fluidly connected to the conduits 372, 374. In order to prevent substantial amounts of fluid from the rod side and cap side fluid connections 172, 174 from draining to the tank 190 through the pilots 360, 362 and conduits 372, 374 when the conduits 372, 374 are fluidly connected to the tank 190, pilots 360, 362 include orifices 376, 378 which allow for a limitation in the flow from the rod and cap side fluid connections 172, 174, respectively. The orifices 376, 378, as well as the structure and respective areas of the first and second actuating ends or surfaces 364, 366, 368, 370, other components of the load holding valves 340,342, and the selective condition of the connection of the conduits 372, 374 to the tank 190, additionally play a roll in the pressure differentials at pressures at which the respective load holding valves 340, 342 move between the flow and no-flow positions 344, 346, 348, 350.

In operation, in order for the loading holding valve 340 to move from its no-flow position 344 to its flow position 348, the force exerted on the first actuating end or surface(s) 364 of the load holding valve 340 must be greater than the force exerted on its second actuating end or surface(s) 368. Conversely, in order for the loading holding valve 340 to move from its flow position 348 to its no-flow position 344, the force exerted on the second actuating end or surface(s) 368 of the load holding valve 340 must be greater than the force exerted on its first actuating end or surface(s) 364. The first actuating end or surface(s) 364 of the load holding valve 340 is open to the fluid pressure from the pump 180 by way of pilot 352 and rod side fluid connection 172, as well as fluid pressure from the rod chamber 168 by way of pilot 354 and rod side fluid connection 172; the second actuating end or surface(s) 368 is open to the tank 190 by way of the selectively connectable conduit 372, as well as fluid pressure from the rod chamber 168 by way of rod side fluid connection 172 and pilot 360 as reduced by orifice 376.

Thus, from the illustrated no-flow position 344 of load holding valve 340, if conduit 372 is opened to the tank 190 (as will be discussed below in greater detail) such that the second actuating end or surface(s) is opened to the tank 190, and a retraction of the actuator 132 is commanded such that the pump 180 provides a flow toward the rod chamber 168 through the rod side fluid connection 172. It will be appreciated that the phrase "provides a flow" is intended to encompass whether the pump 180 is acting as a pump or as a motor. Under these circumstances, the fluid pressure from the pump 180 is applied by way of rod side fluid connection 172 and pilot 352 to the first actuating end or surface(s) 364 to overcome any negligible force on the second actuating end or surface(s) 368 to move the load holding valve 340 to flow position 348 to permit flow from the pump 180 to the rod chamber 168 by way of the rod side fluid connection 172.

Under similar conditions, if the load holding valve 342 is in the no-flow position 346, conduit 374 is opened to the tank 190, and a retraction of the actuator 132 is commanded, the pump 180 provides a flow toward the rod chamber 168 through the rod side fluid connection 172. As the piston 164 moves toward the cap side chamber 170, the pressure within the cap side chamber 170 is conveyed to the first actuating end or surface(s) 366 by way of the cap side fluid connection 174 and pilot 358 to overcome any negligible force on the second actuating end or surface(s) 370. As a result, the load holding valve 342 moves to flow position 350 to permit flow from the cap side chamber 170 to the pump 180 by way of the cap side fluid connection 174.

Conversely, if an extension of the actuator 132 is commanded and the load holding valve 342 is in the no-flow position 346, conduit 374 is opened to the tank 190. As the pump 180 provides a flow toward the cap side chamber 170 through the cap side fluid connection 174, that pressure is conveyed to the first actuating end or surface(s) 366 by pilot 356 to overcome any negligible force on the second actuating end or surface(s) 370. As a result, the load holding valve 342 moves to flow position 350 to permit flow from the pump 180 to the cap side chamber 170 by way of the cap side fluid connection 174.

With the load holding valve 340 in the no-flow position 344, when an extension of the actuator 132 is commanded, conduit 372 is opened to the tank 190. As the pump 180 provides a flow toward the cap side chamber 170 through the cap side fluid connection 174, pressure is on the piston 164. As the piston 164 asserts pressure on the rod chamber 168, this pressure is conveyed to the first actuating end or surface(s) 364 by way of rod side fluid connection 172 and pilot 354 to overcome any negligible force on the second actuating end or surface(s) 368. As a result, the load holding valve 340 moves to flow position 348 to permit flow from the rod chamber 168 to the pump 180 by way of the rod side fluid connection 172.

According to an aspect of the disclosure, when the pump 180 is not commanded, the meterless hydraulic system 104 is turned off, or hydraulic operation of the actuator 132 is locked out, the load holding valves 340, 342 return to their no-flow positions 344, 346 and are maintained in the no-flow positions 344, 346 in order to hold the load in position. To this end, when the pump 180 is not commanded, the meterless hydraulic system 104 is turned off, or hydraulic operation of the actuator 132 is locked out, connection of the second actuating ends or surfaces 368, 370 to the tank 190 through conduits 372, 374 is discontinued.

As a result, flow from the second actuating ends or surfaces 368, 370 can no longer be dumped into the tank 190, and, if the valves 340, 342 are in their no-flow positions 344, 346 already, pressure through any of pilots 352, 354, 356, 358 does not result in an actuation of the respective valve 340, 342 to the flow position 348, 350. Moreover, as pressure builds in the rod side fluid connection 172 between the load holding valve 340 and the actuator 132, pressure from pilot 360 is conveyed to the second actuating end or surface(s) 368 of load holding valve 340 to move, and to maintain the load holding valve 340 in the no-flow position 344. Similarly, as pressure builds in the cap side fluid connection 174 between the load holding valve 342 and the actuator 132, pressure from pilot 362 is conveyed to the second actuating end or surface(s) 370 of load holding valve 342 to move, and to maintain the load holding valve 342 in the no-flow position 346.

While the load holding valves 340, 342 may be of any appropriate design, it will be appreciated that the load holding valves 340, 342 may be designed structurally such that the relative areas of the first actuating ends or surfaces 364, 366, and the second actuating ends or surfaces 368, 370 will result in a shift from the flow positions 348, 350 to the no-flow positions 344, 346, even though pilots 354, 358, 360, 362 extend to both the first actuating ends or surfaces 364, 366, and the second actuating ends or surfaces 368, 370 from the rod side and cap side fluid connections 172, 174, respectively.

Figure 5:
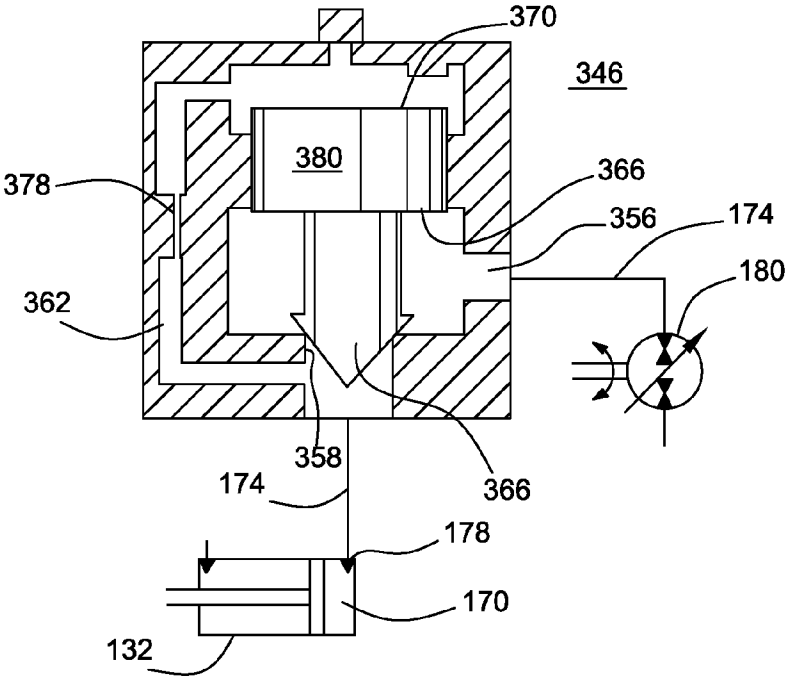
FIG. 5 is a schematic of the exemplary load holding valve according to FIG. 4 in a no-flow position.
Figure 4:
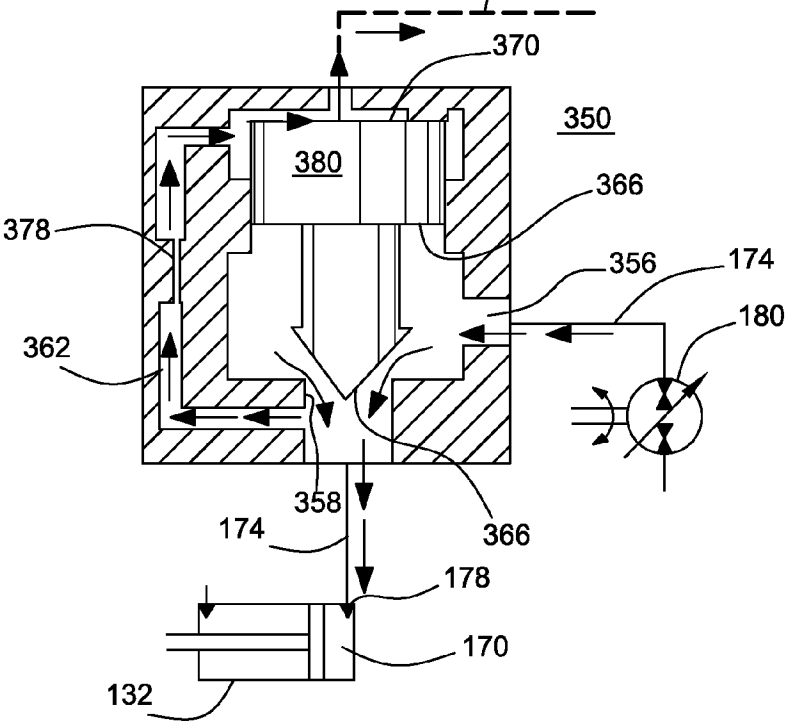
FIG. 4 is a schematic of an exemplary load holding valve according to the disclosure in a flow position.

One example of a load holding valve 340, 342 that would be appropriate for use in the embodiment of FIGS. 2 and 3 is a poppet type valve, such as is illustrated in FIGS. 4 and 5. While the poppet valve of FIGS. 4 and 5 is illustrated as load holding valve 342, the same valve design may likewise be applied to load holding valve 340 by connecting the valve to the rod side fluid connection 172 and the rod chamber 168 of the actuator 132. As shown in FIGS. 4 and 5, load holding valve 342 may be provided with a poppet element 380 moveable between a flow position 350 (FIG. 4) and a no-flow position 346 (FIG. 5). It will be appreciated that the pilots 356, 358 are pictured as ports. For the purposes of this application, the term "pilot" will be interpreted to mean a channel for fluid flow, whether in the form of a port or of an elongated channel.

As discussed in greater detail above, when the second actuating end or surface 370 is open to the tank 190 by way of conduit 374, pilots 356, 358 provide actuating pressure from the pump 180 or cap side chamber 170 by way of the cap side end fluid connection 174 to the first actuating end or surfaces 366. This actuating pressure against the first actuating end or surfaces 366 causes the poppet element 380 to move from the no-flow position 346 illustrated in FIG. 5 to the flow position 350 illustrated in FIG. 4 as fluid at the second actuating end or surface 370 is permitted to drain to the tank 190 by way of conduit 374. This continued pressure and flow against the first actuating end or surfaces 366, while the second actuating end or surface 370 is open to the tank 190 likewise maintains the poppet element 380 in the flow position 350.

When the pump 180 is not commanded, the meterless hydraulic system 104 is turned off, or hydraulic operation of the actuator 132 is locked out, the second actuating surface 370 is no longer open to the tank 190 by way of conduit 374. As a result, pressure from pilot 362 builds against the second actuating end or surface 370, causing the poppet element 380 to move from the flow position 350 of FIG. 4 to the no-flow position 346 of FIG. 5. As pressure continues from the cap side chamber 170 through the cap side fluid connection 174 to pilot 362 and the second actuating end or surface 370, the poppet element 380, and, accordingly, the load holding valve 342 is maintained in the no-flow position 346 of FIG. 5.

Turning now to the selective fluid coupling of the conduits 372, 374 to the tank 190, the conduits 372, 374 may be connected to or disconnected from the tank 190 by any appropriate arrangement. In the embodiment illustrated in FIGS. 2 and 3, the selective fluid coupling of the conduits 372, 374 to the tank 190 is controlled by the operator by way of the operator control 115, the controller 320, and the control circuit 290. As explained above with regard to the control of the pump 180, the operator control 115 to provide a signal that identifies the desired movement of the actuator 132 to the controller 320. Based upon one or more signals, including the signal from the operator control 115, and, for example, the current position of the actuator 132, the controller 320 provides a signal to the solenoid 322, 324 at either end of the control valve 292 to advance the control valve 292 to the desired position 302, 304, 306. Inasmuch as the details of the flow through the control valve 292 are explained in detail above, they will not be repeated in this section. Suffice it to say that flow, that is, fluid pressure, is established through either position 304 or 306 only when the pump 180 is commanded. If the pump 180 is not commanded, the meterless hydraulic system 104 is turned off, or hydraulic operation of the actuator 132 is locked out, the control valve 292 is in the first position 302.

When the control valve 292 is in either its second or third position 304, 306, fluid pressure is established within either conduit 301 or conduit 299 and pilot line 244. This pressure within conduit 301 is may be further conveyed by way of pilot line 382.

In order to provide selective flow between the load holding valves 340, 342 and the tank 190, a load holding control valve 384 is provided. In the illustrated embodiment, pressure from the pilot lines 244 and 382 is applied to either end of the load holding control valve 384 to move the load holding control valve 384 from its first, no-flow position 386 to either its second or third flow position 388, 390. In the first position 386, the load holding control valve 384 disconnects the conduits 372, 374 from the load holding valve 340, 342 and the tank 190. When the load holding control valve 384 is in either the second or third position 388, 390, however, the conduits 372, 374 from the load holding valves 340, 342 are fluidly coupled to a conduit 392, which is further fluidly coupled to return conduit 201 and to the tank 190.

In this way, when motion is commanded of the pump 180, the control valve 292 is moved to either its second or third position 304, 306, establishing fluid pressure to either pilot line 244 or pilot line 382 to move the load holding control valve 384 from its no-flow, first position 386 to one of its flow, second or third position 388, 390 to open the load holding valves 340, 342 to the tank 190. When the pump 180 is no longer commanded, the meterless hydraulic system 104 is turned off, or hydraulic operation of the actuator 132 is locked out, the control valve 292 moves to its first position 302, and the load holding control valve 384 moves to its no-flow, first position 386, discontinuing flow from the second actuating ends or surfaces 368, 370 of the load holding valves 340, 342 to the tank 190. As a result, pressure on the second actuating ends or surfaces builds to move the load holding valves 340, 342 to their no-flow positions 344, 346.

While operation of the load holding control valve 384 of the illustrated embodiment is hydraulically actuated, it will be appreciated that the actuation could be alternately configured. For example, a control valve may be provided for each respective load holding valve 340, 342.

Figure 6:
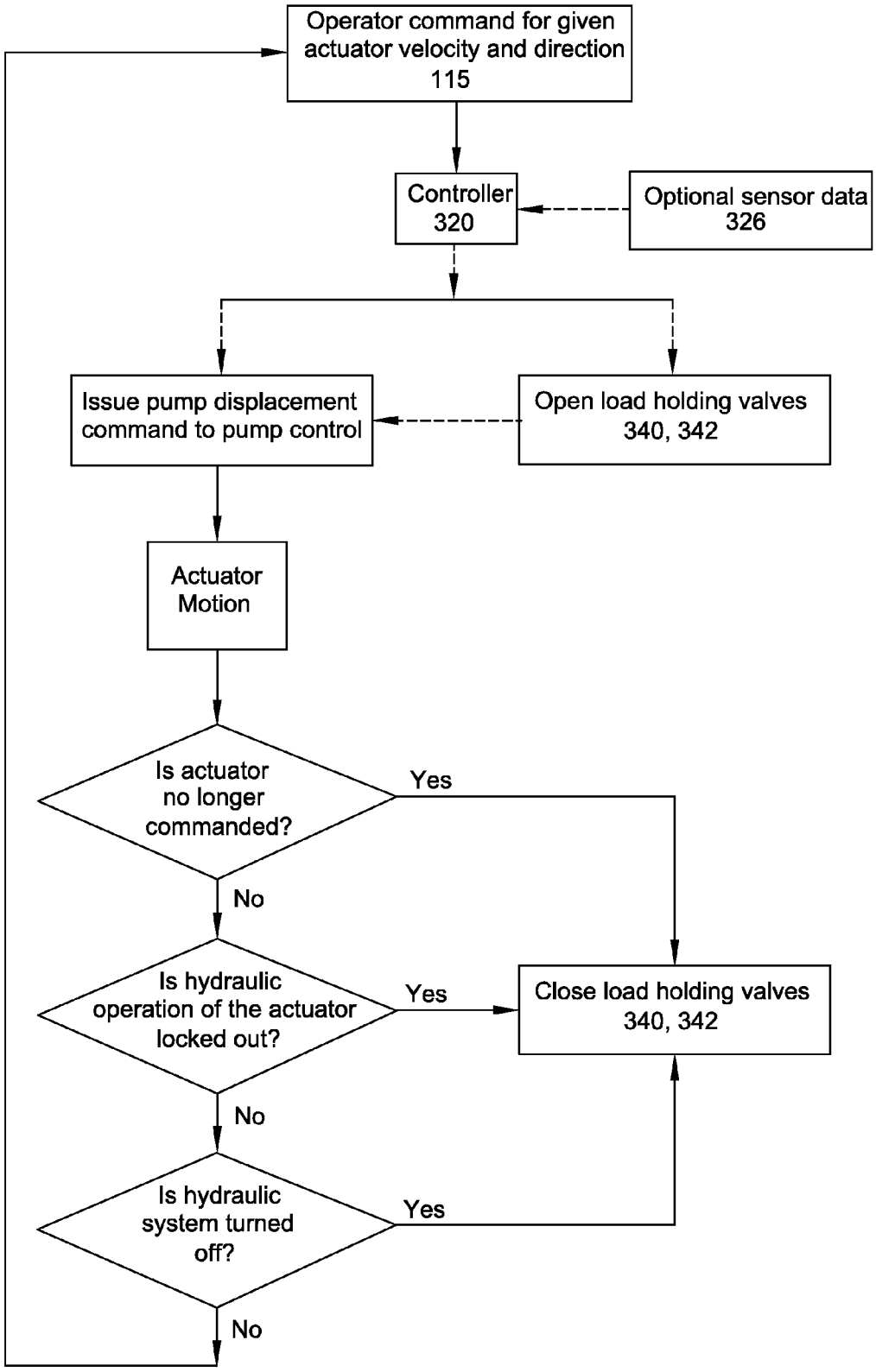
FIG. 6 is an exemplary flow diagram of a method according to the disclosure.

Turning now to FIG. 6, there is illustrated a method of controlling a meterless hydraulic system 104. In the illustrated embodiment, an operator commands motion for a given velocity and direction of actuator 132, generally, utilizing an operator control 115. A signal is provided to a controller 320, the structure of which is discussed in greater detail below. Additional information may likewise be provided to the controller 320, such as, for example, sensor data from pressure transducers (273, 274 as in the next embodiment), one or more position sensors 326, an end of stroke signal switch (not shown), or other sensors, transducers or switches (not shown). Sensor data may include, for example, information regarding pump displacement angle, pump shaft speed, cylinder cap side end pressure, cylinder rod end pressure, cylinder position, rod position relative to the cylinder, or cylinder end of stroke signal.

If no change in the motion of the actuator 132 or operating mode of the system is commanded by the operator, no further action is taken by the controller 320 to modify the displacement of the pump 180 or to the load holding valves 340, 342. If, however, motion of the actuator 132 is commanded, the controller 320 provides a signal which causes the load holding valves 340, 342 to move to an open position, as well as a signal that causes the pump 180 to operate to provide a desired fluid flow to obtain the commanded motion of the actuator 132. The operating mode may be detected, for example, using both the pump displacement command from the operator control 115, from sensors 326, and from load pressure. The load pressure is the difference in pressure between the cap side chamber 170 and rod chamber 168, and may be determined by pressure transducers.

In the embodiment of FIGS. 2-3, the load holding valves 340, 342 are actuated by way of hydraulic pressure delivered as a result of the actuation of solenoid 322, 324. When the solenoid 322, 324 is no longer actuated, the load holding control valve 384 moves to the no-flow position 386, and load holding valves 340, 342 move to their no flow positions 344, 346. Thus, referring to FIG. 6, if the actuator 132 is no longer commanded, load holding valves 340, 342 close. Similarly, if the hydraulic system 104 is turned off, load holding valves 340, 342 close. Further, if the operator locks out operation of the hydraulic system 104 by way of the hydraulic lock out switch 113, the load holding valves 340, 342 close. In each of these instances, when the load holding valves 340, 342 are in their no flow positions 344, 346, block hydraulic fluid from moving into or out of the work ports 176, 178 of the actuator 132. In other words, the load holding valves 340, 342 substantially maintain the actuator 132 in its last position.

Turning now to the embodiment of FIG. 7, there is provided a meterless hydraulic system 250. The meterless hydraulic system 250 includes a prime mover 257 that drives a variable displacement pump 258 that is fluidly coupled to a cap side chamber 259 of an actuator 260 by a cap side end fluid connection 261 and a rod chamber 262 of the actuator 260 by a rod end fluid connection 263. Cross-over relief valves 264, 265 are disposed and selectively actuatable to fluidly couple the cap side end fluid connection 261 and the rod end fluid connection 263, respectively, to the charge circuit. A charge circuit 266 provides or receives excess hydraulic fluid during execution of control commands by way of solenoid 268, 269 operated valves 254, 256. A controller 272 receives control commands from an operator control 267, and provides instruction for operation of the pump 258, and solenoids 268, 269. The valves 254, 256 may be operated as both make-up valves or as regeneration valves. In a regeneration mode of a motoring retraction of the actuator 260, the controller 272 provides one or more signals to open both valves 254, 256 to provide a direct connection between the cap side end fluid connection 261 and the rod end fluid connection 263. When the solenoids 268, 269 are deactivated, springs 270, 271 return the valves 254, 256 to their original no-flow positions.

Additional signals may be provided to the controller 272, such as an implement or hydraulic lockout switch 289. The current position of the actuator 260 may be determined, for example, by way of one or more sensors provided, by way of further example, on the rod 288 or cylinder 286 of the actuator 260. Alternately, the position of the piston 285 within the actuator 260 may be estimated by techniques known to those of skill in the art. It will be appreciated, however, that any appropriate method of determining the position of the actuator 260 now known or identified in the future may be utilized.

Load holding valves 275, 276 are provided in the rod and cap side fluid connections 263, 261, respectively, to substantially prevent flow to and from the rod chamber 262 and the cap side chamber 259 of the actuator 260, for example, when movement of the pump 258 is not commanded, the hydraulic system 250 is turned off, or hydraulic operation of the actuator 260 is locked out. The load holding valves 275, 276 of this embodiment are electronically actuated by solenoids 277, 278 to move the valves 275, 276 from a closed position 281, 282 to an open position 279, 280. The load holding valves 275, 276 may be returned to the closed position 281, 282 from the open position 279, 280 by way of deactivation of the solenoids 277, 278 and force exerted by springs 283, 284.

In operation, the operator utilizes the operator control 267 to issue a command for a given actuator 260 velocity and direction, which provides a pump displacement command to a controller 272. The controller 272 provides one or more signals to maintain or move the load holding valves 275, 276 to their flow positions 279, 280 to allow flow through the rod and cap side fluid connections 263, 261. When the pump 258 is no longer commanded, the hydraulic system 250 is turned off, or hydraulic operation of the actuator 260 is locked out, the load holding valves 275, 276 return to their no-flow positions 281, 282 to prevent flow through the rod and cap side fluid connections 263, 261.

In this embodiment, however, the load holding valves 275, 276 may be commanded to provide a cushioning arrangement for movement of the piston 285 within the cylinder 286 of the actuator 260. In other words, during normal operation, the load holding valves 275, 276 may be modulated to provide cushioning as the piston 285 nears the end stops of the cylinder 286.

The position of the piston 285 may be determined by any appropriate method or mechanism. For example, the position may be provided by a position sensor. Alternately, the position may be determined based upon the inferred piston velocity achieved from knowledge of the pump's displacement and the area of the hydraulic cylinder. In this way, as the controller 272 determines that the piston 285 is nearing the end of the cylinder 286, the controller 272 provides a signal to one or both of the solenoids 277, 278, which operate to provide a controlled movement of the valves 275, 276 from their flow positions 279, 280 to their no-flow positions 281, 282, thereby cushioning the piston 285 as it nears an end of the cylinder 286.

The meterless hydraulic system 250 may also be utilized with a method of controlling the load holding valves 275, 276 to cushion the movement of the piston 285 as it approaches either end of the cylinder 286 to eliminate or minimize opportunity for structural vibration and a loud sound or "clanging" when the piston 285 nears the end of the cylinder 286. The current position of the actuator 260 may be determined, for example, by way of one or more sensors 287 provided, by way of further example, on the rod 288 or cylinder 286 of the actuator 260. Alternately, the position of the piston 285 within the cylinder 286 may be estimated by techniques known to those of skill in the art. It will be appreciated, however, that any appropriate method of determining the position of the actuator 260 now known or identified in the future may be utilized. The meterless hydraulic system 250 may likewise include one or more of additional sensor or pressure transducers 273, 274 or similar sensors disposed to additionally provide pressures at the work ports of the actuator 260 to the controller 272.

Pressure transducers 273, 274 or similar sensors may be disposed to additionally provide pressures at the work ports of the actuator 260 to the controller 272. Additional sensors may be disposed to provide information to the controller 272. For example, a position sensor or the like may be provided to identify the position of the piston 285 within the actuator 260. Alternately, the position of the piston 285 within the actuator 260 may be estimated by techniques known to those of skill in the art. It will be appreciated, however, that any appropriate method of determining the position of the actuator 260 now known or identified in the future may be utilized.

Based upon the command and optionally other inputs, the controller 272 issues a command to the pump 258, and, as appropriate, commands to either or both of the valves 254, 256. For example, in a pumping extension, valve 256 may be opened in order to provide additional fluid from the charge system to the rod side fluid connection 263. Conversely, during a motoring extension, valve 254 may be opened in order to provide additional fluid directly to the cap side fluid connection 261. During a pumping retraction, valve 254 may be opened in order to provide a path for excess flow from the cap side chamber 259 through the cap side fluid connection 261. Finally, as indicated above, during a motoring retraction, both valves 254, 256 are opened to provide a direct fluid connection from the cap side fluid connection 261 to the rod side fluid connection 263 in order to minimize opportunity for overspeeding; in this configuration, connection is likewise provided to the charge circuit 266 in the illustrated embodiment. Additionally, based upon the command as well as the work port pressures provided by the pressure transducers 273, 274, the controller 272 may issue commands to the valves 254, 256 to control the pressure and maintain a desired speed of the actuator 260.

Figure 8:
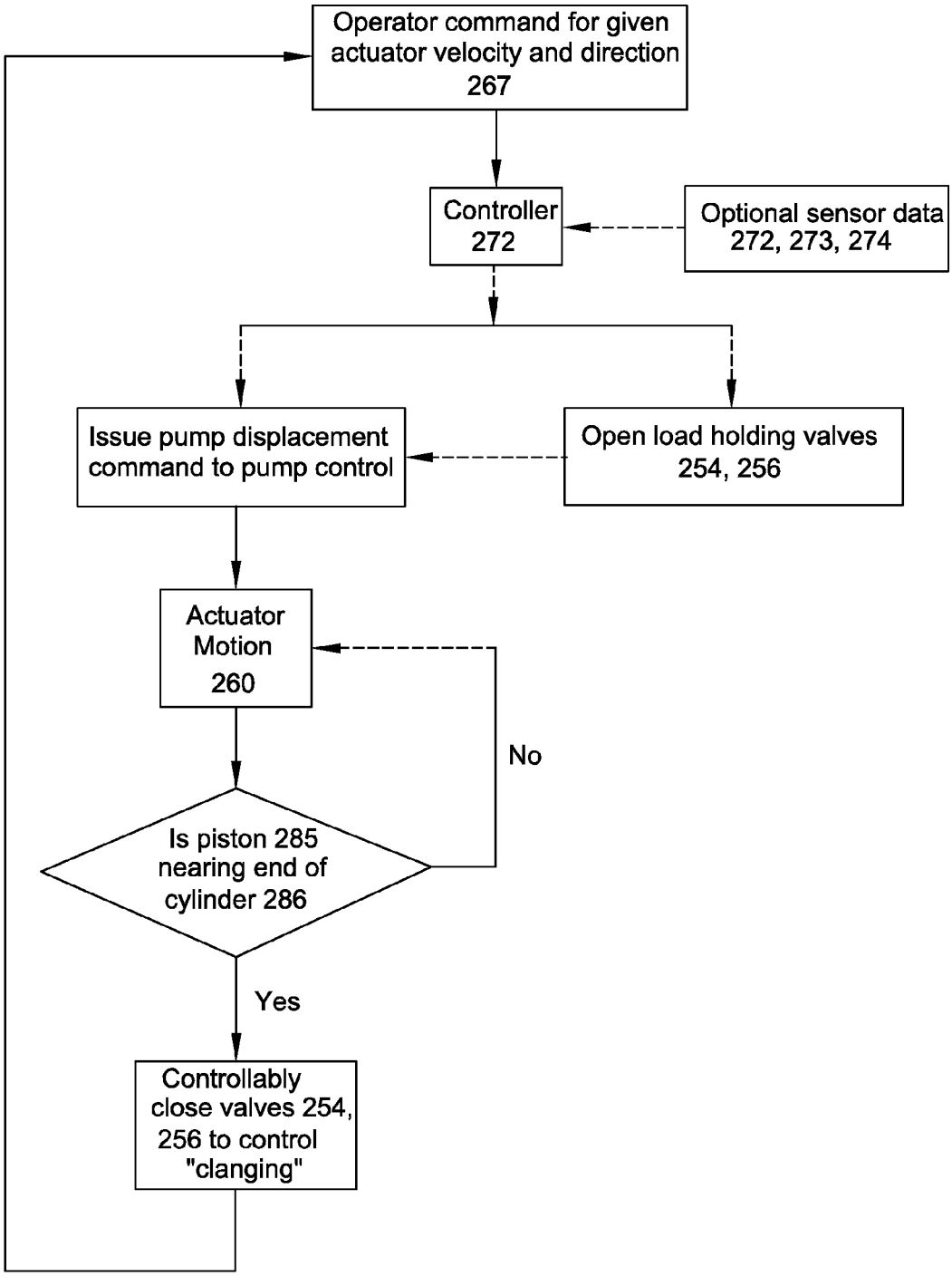
FIG. 8 is an exemplary flow diagram of an alternate method according to the disclosure.

In the embodiments of both FIGS. 2-3 and FIG. 7 and the method of FIGS. 6 and 8, the controller 320, 272 may be one or more controllers, and may include a processor (not shown) and a memory component (not shown). The processor may be microprocessors or other processors as known in the art. In some embodiments, the processor may be made up of multiple processors. The processor may execute instructions for generating a required fluid flow to provide the actuator 132, 260 velocity, and, accordingly, desired displacement of the pump 180, 258, as well as for actuation of valves 292, 275, 276. Such instructions may be read into or incorporated into a computer readable medium, such as the memory component or provided external to processor. In alternative embodiments, hard-wired circuitry may be used in place of or in combination with software instructions to implement a desired fluid flow from the pump, as well as actuation of valves 292, 275, 276. Thus, embodiments are not limited to any specific combination of hardware circuitry and software.

It is additionally noted that several hierarchical controllers might be utilized. For example, a high-level controller can generate set points for engine power management and operator command signal conditioning (mapping lever positions to percent commands for example). A medium-level controller can be used to detect operating modes and issue valve/pump commands. Low-level controllers can then carry on the commands from higher level controllers such as to achieve the desired pump displacement.

The term "computer-readable medium" as used herein refers to any medium or combination of media that participates in providing instructions to processor for execution. Such a medium may take many forms, including but not limited to, non-volatile media, volatile media, and transmission media. Non-volatile media includes, for example, optical or magnetic disks. Volatile media includes dynamic memory. Transmission media includes coaxial cables, copper wire and fiber optics.

Similarly, common forms of computer-readable media include, for example, a floppy disk, a flexible disk, hard disk, magnetic tape, or any other magnetic medium, a CD-ROM, any other optical medium, punch cards, paper tape, any other physical medium with patterns of holes, a RAM, a PROM, and EPROM, a FLASH-EPROM, any other memory chip or cartridge, or any other medium from which a computer or processor can read. The memory component may include any form of computer-readable media as described below. The memory component may include multiple memory components.

The controller 320, 272 may be enclosed in a single housing. In alternative embodiments, the controller 320, 272 may include a plurality of components operably connected and enclosed in a plurality of housings. The controller 272 may be an integral part of a control panel (not shown) and may be fixedly connected to a terminal box (not shown). In another embodiment, the controller 320, 272 may be fixedly attached to the prime mover 194, 257, a generator (not shown), the cab 108, the undercarriage 110, and/or a frame (not identified) in a location other than the terminal box. In still other embodiments the controller 320, 272 may be located in a plurality of operably connected locations including being fixedly attached to the frame, the prime mover 194, 257, the generator, the terminal box, the cab 108, the undercarriage 110, and/or remotely to the generator.

The controller 320, 272 may be configured to generate a desired pump displacement signal and signals, were appropriate, to operate the valves 292, 275, 276 as a function of the operator control signal and the actuator 132, 260 position signal or other sensor data. In one embodiment, one or more commands from the controller 320, 272 may be signals that command one or both of the valves 292, 254, 256, 275, 276 to move to a desired position, as well as, for example, command actuation of one or more solenoids 322, 324, 268, 269, 277, 278 to move an associated valve 292, 254, 256, 275, 276, for example, to the desired position to adjust a swash plate 181 of the pump 180, 258, or to establish flow through a valve 292, 254, 256, 275, 276. In other embodiments, the desired pump displacement signal may be a digital signal, or any other signal that would control, actuate, or position the swash plate that would be known by an ordinary person skilled in the art now or in the future. In other embodiments, one or more commands from the controller may be signals that command a motor associated with a fixed displacement pump to provide the desired fluid flow from the pump (not shown).

The controller 320, 272 may be communicatively coupled to the solenoids 322, 324, 268, 269, 277, 278 or the valves 292, 254, 256, 275, 276 through at least one signal output port. The controller 320, 272 may be communicatively coupled to the position sensor (326, 272) to receive the position signal. The controller 320, 272 may be communicatively coupled to the solenoid 322, 324, 268, 269, 277, 278. The controller 320, 272 may be communicatively coupled to the operator control 115, 267 to receive the signal corresponding to a commanded motion. The controller 320, 272 may be communicatively coupled to a display (not shown).

Industrial Applicability

The present disclosure is applicable to machines that utilize meterless control systems to provide movement of hydraulic actuators. More particularly, it is applicable to such systems in, for example, hydraulic excavators, wheel loaders, and skid steer loaders.

In one or more embodiments, hydraulic fluid pressure within the system may be applied to load holding valves to substantially hold a load in position.

In one or more embodiments, load holding may be passively accomplished when movement of the piston is not commanded. In one or more embodiments, load holding may be passively accomplished when the hydraulic system is turned off. In one or more embodiments, load holding may be passively accomplished when hydraulic operation of the actuator is locked out.

In embodiments of the disclosure, flow provided by the pump 180, 258 is substantially unmetered or restricted such that energy is not lost in the metering process. Thus, embodiments of the disclosure may provide improved energy usage and conservation. In some embodiments, a high performance (fast response) pump 180, 258 may not be required.

One or more embodiments may eliminate the need for metering valves controlling fluid flow for operation of an actuator. Inasmuch as metering valves may be inefficient, one or more of the disclosed arrangements and/or methods may be more efficient than traditional metering systems.

In one or more embodiments, load holding valves may be utilized to cushion the load when the piston nears the ends of the cylinder.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

We claim:

1. A hydraulic system comprising:

an actuator having a piston disposed within a cylinder, and a rod extending from the piston and extending out of the cylinder, the piston defining a rod chamber and a cap side chamber within the cylinder, a pump adapted to operate as a pump or as a motor, the pump being adapted to selectively provide varied flow rates, the pump being adapted to deliver pressurized hydraulic fluid to and receive pressurized hydraulic fluid from the chambers of the actuator, movement of the piston relative to the cylinder being dependent upon the selectively varied flow rates, a controller configured to control the displacement of the pump in response to a commanded motion and relative positions of the piston and cylinder, a rod side fluid connection between the pump and the rod chamber, a cap side fluid connection between the pump and the cap side chamber, a first mechanical hydraulic valve disposed in the cap side fluid connection, the first mechanical hydraulic valve having at least a first position preventing flow through the cap side fluid connection, and a second position permitting flow through the cap side fluid connection, the first mechanical hydraulic valve being adapted to be disposed in at least one of its first or second positions as a result of a first hydraulic pressure differential applied across the first mechanical hydraulic valve, and a second mechanical hydraulic valve disposed in the rod side fluid connection, the second mechanical hydraulic valve having at least a first position preventing flow through the rod side fluid connection, and a second position permitting flow through the rod side fluid connection, the second mechanical hydraulic valve being adapted to be disposed in at least one of its first or second positions as a result of a second hydraulic pressure differential applied across the second mechanical hydraulic valve, wherein the first and second mechanical hydraulic valves are maintained in the respective first positions when the pump is not operative.

2. The hydraulic system of claim 1 wherein the pump is a variable displacement pump.

3. The hydraulic system of claim 1 wherein the first mechanical hydraulic valve includes first and second actuating surfaces of the first mechanical hydraulic valve, the second mechanical hydraulic valve includes first and second actuating surfaces of the second mechanical hydraulic valve, the hydraulic system further including at least one first fluid takeoff from the cap side fluid connection to the second actuating surface of the first mechanical hydraulic valve and at least one second fluid takeoff from the rod side fluid connection to the second actuating surface of the second mechanical hydraulic valve, the first fluid takeoff being adapted to direct hydraulic fluid pressure from the cap side chamber through the cap side fluid connection to the first actuating surface of the first mechanical hydraulic valve to move or maintain the second mechanical hydraulic valve in its first position, and the second fluid takeoff being adapted to direct hydraulic fluid pressure from the rod chamber through the rod side fluid connection to the second actuating surface of the second mechanical hydraulic valve to move or maintain the second mechanical hydraulic valve in its first position.

4. The hydraulic system of claim 3 further including at least one third fluid takeoff from the cap side fluid connection to the first actuating surface of the first mechanical hydraulic valve and at least one fourth fluid takeoff from the rod side fluid connection to the first actuating surface of the second mechanical hydraulic valve, the third fluid takeoff being adapted to direct hydraulic fluid pressure from the cap side chamber through the cap side fluid connection to the first actuating surface of the first mechanical hydraulic valve to move or maintain the first mechanical hydraulic valve in its second position, and the fourth fluid takeoff being adapted to direct hydraulic fluid pressure from the rod chamber through the rod side fluid connection to the first actuating surface of the second mechanical hydraulic valve to move or maintain the second mechanical hydraulic valve in its second position.

5. The hydraulic system of claim 3 further comprising a hydraulic fluid source and a makeup hydraulic circuit disposed to provide selective flow between the cap side fluid connection and the hydraulic fluid source, and between the rod side fluid connection and the hydraulic fluid source, the make-up hydraulic circuit including a second pump and at least one makeup valve, the second pump being disposed to provide hydraulic fluid from the hydraulic fluid source to the makeup valve, the makeup valve being operable in response to a minimum pressure differential between the rod side fluid connection and the cap side fluid connection to provide said selective flow between the cap side fluid connection and the hydraulic fluid source, and between the rod side fluid connection and the hydraulic fluid source.

6. The hydraulic system of claim 3 further comprising an electro-hydraulic displacement control circuit including at least one valve and a fluid connection to at least one of said first and second actuating surfaces of said first and second mechanical hydraulic valves, operation of said at least one valve selectively providing hydraulic fluid flow through said fluid connection or preventing hydraulic fluid flow through said fluid connection.

7. The hydraulic system of claim 1 further including at least one position sensor associated with at least one of the cylinder and the rod, the position sensor being adapted to provide a signal to the controller.

8. A method of controlling a hydraulic system including an actuator having a piston disposed within a cylinder, and a rod extending from the piston and extending out of the cylinder, the piston defining a rod chamber and a cap side chamber within the cylinder, a pump, a rod side fluid connection between the pump and the rod chamber, and a cap side fluid connection between the pump and the cap side chamber, the pump adapted to deliver pressurized fluid to and receive pressurized fluid from the chambers of the actuator, the method comprising the steps of:

disposing a first mechanical hydraulic valve in the cap side fluid connection, the first valve having at least a first position substantially preventing flow through the cap side fluid connection, and a second position permitting flow through the cap side fluid connection, disposing a second mechanical hydraulic valve in the rod side fluid connection, the second valve having at least a first position substantially preventing flow through the rod side fluid connection, and a second position permitting flow through the rod side fluid connection, moving the first mechanical hydraulic valve from its first position to its second position to allow flow through the cap side fluid connection and moving the second mechanical hydraulic valve from its first position to its second position to allow flow through the rod side fluid connection when motion of the actuator is commanded, controlling the pump to control the flow rate in response to relative positions of the piston and cylinder and a commanded motion of the actuator, moving the first mechanical hydraulic valve from its second position to its first position and moving the second mechanical hydraulic valve from its second position to its first position when at least one of movement of the piston is not commanded or the hydraulic system is turned off, at least one of the steps of moving occurring as a result of a pressure differential across the respective mechanical hydraulic valve.

9. The method of claim 8 wherein the steps of moving the first and second mechanical hydraulic valves include steps of directing hydraulic pressure to first or second mechanical hydraulic valve to move the first or second mechanical hydraulic valve from its first to its second position.

10. The method of claim 8 wherein the step of moving the first mechanical hydraulic valve from its second position to its first position includes directing hydraulic pressure from the cap side fluid connection to a second actuating surface of the first mechanical hydraulic valve to move the first mechanical hydraulic valve from the second to the first position or to maintain the first mechanical hydraulic valve in the first position to substantially prevent flow through the cap side fluid connection, and the step of moving the second mechanical hydraulic valve from its second position to its first position includes directing hydraulic pressure from the rod side fluid connection to a second actuating surface of the second mechanical hydraulic valve to move the second mechanical hydraulic valve from the second to the first position or to maintain the second mechanical hydraulic valve in the first position to substantially prevent flow through the rod side fluid connection.

11. The method of claim 8 wherein the step of moving the first mechanical hydraulic valve from its first position to its second position includes directing hydraulic fluid pressure from the cap side fluid connection to a first actuating surface of the first mechanical hydraulic valve, and the step of moving the second mechanical hydraulic valve from its first position to its second position includes directing hydraulic fluid pressure from the rod side fluid connection to a first actuating surface of the second mechanical hydraulic valve.

12. The method of claim 8 further comprising the steps of a controller receiving a signal from an operator input, the controller directing an electro-hydraulic displacement control circuit including at least one load holding control valve and at least one fluid connection to at least one a first and second actuating surface of at least one of the first and second mechanical hydraulic valves, the controller providing a signal to operate said at least one load holding control valve to selectively provide hydraulic fluid flow through said at least one fluid connection in response to a commanded motion, deactivating said fluid connection from said at least one load holding valve to said first or second actuating surface to substantially prevent flow through said fluid connection when no motion is commanded.

13. The method of claim 8 wherein the step of moving the first mechanical hydraulic valve from its second position to its first position includes directing hydraulic pressure from the cap side fluid connection to a second actuating surface of the first mechanical hydraulic valve to move the first mechanical hydraulic valve from its second to the first position or to maintain the first mechanical hydraulic valve in its first position to substantially prevent flow through the cap side fluid connection, and the step of moving the second mechanical hydraulic valve from its second position to its first position includes directing hydraulic pressure from the rod side fluid connection to a second actuating surface of the second mechanical hydraulic valve to move the second mechanical hydraulic valve from the second to the first position or maintain the second mechanical hydraulic valve in its first position to substantially prevent flow through the rod side fluid connection, the step of moving the first mechanical hydraulic valve from its first position to its second position includes directing hydraulic fluid pressure from the cap side fluid connection to a first actuating surface of the first mechanical hydraulic valve, and the step of moving the second mechanical hydraulic valve from its first position to its second position includes directing hydraulic fluid pressure from the rod side fluid connection to a first actuating surface of the second mechanical hydraulic valve.

14. A method of controlling a hydraulic system including an actuator having a piston disposed within a cylinder, and a rod extending from the piston and extending out of the cylinder, the piston defining a rod chamber and a cap side chamber within the cylinder, a pump, a rod side fluid connection between the pump and the rod chamber, and a cap side fluid connection between the pump and the cap side chamber, the pump adapted to deliver pressurized fluid to and receive pressurized fluid from the chambers of the actuator, the method comprising the steps of:

disposing a first load holding valve in the cap side fluid connection, the first valve having at least a first position substantially preventing flow through the cap side fluid connection, and a second position permitting flow through the cap side fluid connection, disposing a second load holding valve in the rod side fluid connection, the second valve having at least a first position substantially preventing flow through the rod side fluid connection, and a second position permitting flow through the rod side fluid connection, controlling the pump to control the flow rate in response to relative positions of the piston and cylinder and a commanded motion of the actuator, moving the first load holding valve from its first position to its second position to allow flow through the cap side fluid connection when motion of the actuator is commanded, moving the second load holding valve from its first position to its second position to allow flow through the rod side fluid connection when motion of the actuator is commanded, determining when the piston is within a predetermined distance of an end of the cylinder, cushioning the movement of the piston as it nears the end of the cylinder by controllably moving at least one of the first or second load holding valves from its second position to its first position to reduce a flow rate of fluid to and from the rod and cap side chambers, moving the first load holding valve from its second position to its first position when the pump is not commanded, the hydraulic system is turned off, or hydraulic operation of the actuator is locked out, and moving the second load-holding valve from its second position to its first position when at least one of the pump is not commanded, the hydraulic system is turned off, or hydraulic operation of the actuator is locked out.

15. The method of claim 14 wherein the step of moving the first load holding valve from its first position to its second position includes at least one controller energizing a first solenoid associated with the first load holding valve, the step of moving the second load holding valve from its first position to its second position includes the controller energizing a second solenoid associated with the second load holding valve, the step of moving the first load holding valve from its second position to its first position includes de-energizing the first solenoid when at least one of the pump is not commanded, the hydraulic system is turned off, or hydraulic operation of the actuator is locked out, and the step of moving the second load holding valve from its second position to its first position includes de-energizing the second solenoid when at least one of the pump is not commanded, the hydraulic system is turned off, or hydraulic operation of the actuator is locked out.

16. The method of claim 15 further including steps of reading a first hydraulic pressure proximal to the cap side chamber, providing a first signal representing the first hydraulic pressure, reading a second hydraulic pressure proximal to the rod chamber, providing a second signal representing the second hydraulic pressure, controlling at least one of the first and second load holding valves to provide desired first and second hydraulic pressures to provide a desired actuator speed.

17. The method of claim 14 wherein the determining step includes a step of providing a signal from at least one of a position sensor or a proximity sensor to a controller.

18. The method of claim 14 wherein the determining step includes a step of calculating the location of the piston with the cylinder based upon at least one of calculated piston speed and fluid flow rate.

19. The method of claim 14 wherein the controlling step includes a controller providing a signal to control the flow rate of the pump, and the cushioning step includes the controller providing a signal to at least one of the first or second load holding valves to provide a controlled movement of the at least one of the first or second load holding valves from its second position to its first position to reduce the flow rate of fluid to and from the rod and cap side chambers.

* * * * *